US007013860B2

(12) United States Patent
Takeuchi

(10) Patent No.: US 7,013,860 B2
(45) Date of Patent: Mar. 21, 2006

(54) DRY-SUMP, FOUR-STROKE ENGINE LUBRICATION DEVICE

(75) Inventor: Yoshihiko Takeuchi, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/889,665

(22) Filed: Jul. 12, 2004

(65) Prior Publication Data

US 2005/0011483 A1 Jan. 20, 2005

(30) Foreign Application Priority Data

Jul. 14, 2003 (JP) ..... 2003-196500

(51) Int. Cl.
*F01M 1/00* (2006.01)

(52) U.S. Cl. ..... 123/196 R; 123/198 R

(58) Field of Classification Search ..... 123/196 R, 123/198 R, 55.4
See application file for complete search history.

(56) References Cited

U.S. PATENT DOCUMENTS 6,332,444 B1 * 12/2001 Narita et al. ..... 123/196 R

FOREIGN PATENT DOCUMENTS

JP 2000-282826 10/2000

* cited by examiner

*Primary Examiner*—Tony M. Argenbright
*Assistant Examiner*—Katrina Harris
(74) *Attorney, Agent, or Firm*—Hogan & Hartson, L.L.P.

(57) ABSTRACT

A lubrication device for a dry-sump, four-stroke engine includes a crankcase having a divider wall interposed between a crank chamber and a separate adjoining chamber. A crankshaft is housed in the crank chamber and is driven by reciprocating movement of pistons. A crank web faces the divider wall, which has a through hole for connecting the crank chamber with the separate chamber, and is opened by the crank web when the piston moves from a top dead center position toward a bottom dead center position, and is closed when the piston moves from the bottom dead center toward the top dead center position. A return hole connects the crank chamber and the separate chamber, for returning lubricant oil that flowed through the through hole into the separate chamber from the crank chamber, back to the crank chamber by utilizing pressure fluctuations within the crank chamber.

20 Claims, 16 Drawing Sheets

(B)

(A)

DRY-SUMP, FOUR-STROKE ENGINE LUBRICATION DEVICE

BACKGROUND OF THE INVENTION

1. Field of the Invention

The present invention relates to a lubrication device for a dry-sump, four-stroke engine formed with through holes for absorbing a fluctuating pressure within a crank chamber, which is installed for example in a wall separating a clutch chamber and the crank chamber, and relates in particular to a mechanism for accelerating the return of lubricant oil to the crank chamber during a piston's movement from a bottom dead center position to a top dead center position.

2. Description of Related Art

In dry-sump, four-cycle engines not possessing an effective oil pan in the bottom of the crank chamber, when the diameter of a crank web is enlarged to increase the inertial mass of a crankshaft, the outer circumferential surface of the crank web nears the bottom of the crank chamber.

The increase in pressure inside the crank chamber while the piston falls downward from the top dead center to the bottom dead center is especially large in large displacement single-cylinder and V-type two-cylinder engines so that the lubricant oil in the vicinity of the crank web is blown away due to the air pressure that accompanies the fall of the piston.

Motorcycle engines, however, contain a clutch chamber housing a wet-type clutch on the side of the crank chamber. This clutch chamber adjoins the crank chamber with the sidewall of the crankcase interposed in between them. In conventional engines, multiple through holes (breather holes) are formed in the sidewall of the crankcase to connect the crank chamber and the clutch chamber in order to alleviate pressure fluctuations within the crank chamber during a downward movement of the piston. These through holes are formed at a position higher than the fluid surface of the lubricant oil within the clutch chamber. When the piston moves downward, these through holes allow gas inside the crank chamber to escape into the clutch chamber.

However when these through holes in the sidewall are open, the lubricant oil is blown away from the periphery of the crank web, and cannot be prevented from flowing into the clutch chamber from the through holes. In view of this problem, oil return holes are formed in the lower section of the crank case sidewall, and the pressure fluctuation in the crank chamber occurring when the piston moves from a bottom dead center position to a top dead center position is utilized to draw into the crank chamber, the lubricant that flowed into the clutch chamber.

The crankcase through holes are always open in both the crank chamber and the clutch chamber. Therefore when a negative pressure occurs in the crank chamber from the piston moving upward, the through holes function as intake holes and a negative pressure acts on the clutch chamber. The pressure differential between the crank chamber and the clutch chamber therefore can be relieved, and this makes it difficult for lubricant oil to return to the crank chamber from the clutch chamber.

Consequently, an increase in the amount of oil, not contributing to engine lubrication, accumulates in the clutch chamber while the engine is running. Lubricant oil has to be refilled by an amount equal to this oil accumulated in the clutch chamber. This situation leads to problems since the oil tank has to be enlarged, the level of lubricant oil inside the clutch chamber rises, and the lubricant oil agitation resistance increases due to the wet-type clutch.

A countermeasure for this problem known in the prior art is the use of dry-sump, four-cycle engines provided with a reed valve in the oil drain port open on the bottom of the crank chamber. This reed valve is designed to open when the pressure in the crank chamber increases and allows the lubricant oil to flow from the crank chamber towards the transmission chamber. In other words, the reed valve closes at the point in time that the piston rises and creates a negative pressure in the crank chamber. A pressure differential is in this way maintained between the crank chamber and the transmission chamber.

The conventional four-stroke engine requires a dedicated reed valve for maintaining a pressure differential between the crank chamber and the clutch chamber while the piston is rising. This requires increasing the number of engine parts, requires drastic changes to the crankcase design to be used for already built engines, and therefore leads to higher costs.

A further problem with the above engine of the prior art is that it also requires providing a space for installing the reed valve at the bottom of the crankcase. The bottom of the crankcase therefore protrudes downward in localized sections. The overall height of the engine therefore becomes larger and the merits of the dry-sump, four-stroke engine are lost.

The reed valve further has a body made of a thin metal capable of resilient deformation according to pressure fluctuations within the crank chamber. This reed valve is adjacent to the outer circumferential surface of the crank web rotating at a high speed. This valve body might collapse and be destroyed if it is repeatedly subjected to pressure from the crank chamber. In that case, the valve body might make contact with the crank web and valve body debris might fly into the crank chamber. Therefore this debris might possibly cause damage to the crankshaft bearing or the section coupling the crank pin and crankshaft.

In view of the problems with the prior art, the present invention has an advantage of providing a lubrication device for a dry-sump, four-stroke engine with a simple design, capable of returning lubrication oil to the crank chamber from another chamber and eliminating cost problems.

SUMMARY OF THE INVENTION

The lubrication device for a dry-sump, four-stroke engine of the embodiment of the present invention, includes a crankcase having a divider wall, a crank chamber and a separate adjoining chamber with the divider wall interposed in between them. The device also includes a crankshaft housed in the crank chamber, driven by a reciprocating movement of pistons, and having a crank web adjoining the divider wall, a through hole formed in the divider wall for connecting the crank chamber with the separate chamber, and opened by the crank web when the piston moves from a top dead center position toward a bottom dead center position, and closed by the crank web when the piston moves from the bottom dead center position toward the top dead center position. A return hole connects the crank chamber and the separate chamber, for returning the lubricant oil that flowed by way of the through hole into the separate chamber from the crank chamber, back to the crank chamber by utilizing pressure fluctuations within the crank chamber. An oil pump suctions up lubricant oil from the bottom of the crank chamber.

In this type of structure, the through holes open in the stroke where the piston moves from the top dead center position toward the bottom dead center position so gas within the crank chamber is pressed along with the lubricant oil into another chamber. The pressure fluctuation within the crank chamber is therefore alleviated and pumping loss is reduced.

In the stroke where the piston moves from the bottom dead center position to the top dead center position, the crank web blocks the through holes. The crank web and the through holes therefore function as a check valve. The negative pressure generated in the crank chamber therefore cannot escape to the separate chamber by way of the through holes, so that a large pressure differential occurs between the crank chamber and the separate chamber. Lubricant oil that flowed into the separate chamber can therefore be efficiently suctioned from the return holes in the crank chamber, and the lubricant oil can efficiently return to the crank chamber.

DETAILED DESCRIPTION OF THE PREFERRED EMBODIMENTS

The first embodiment of the present invention is described next referring to FIG. 1 through FIG. 11.

Figure 1:
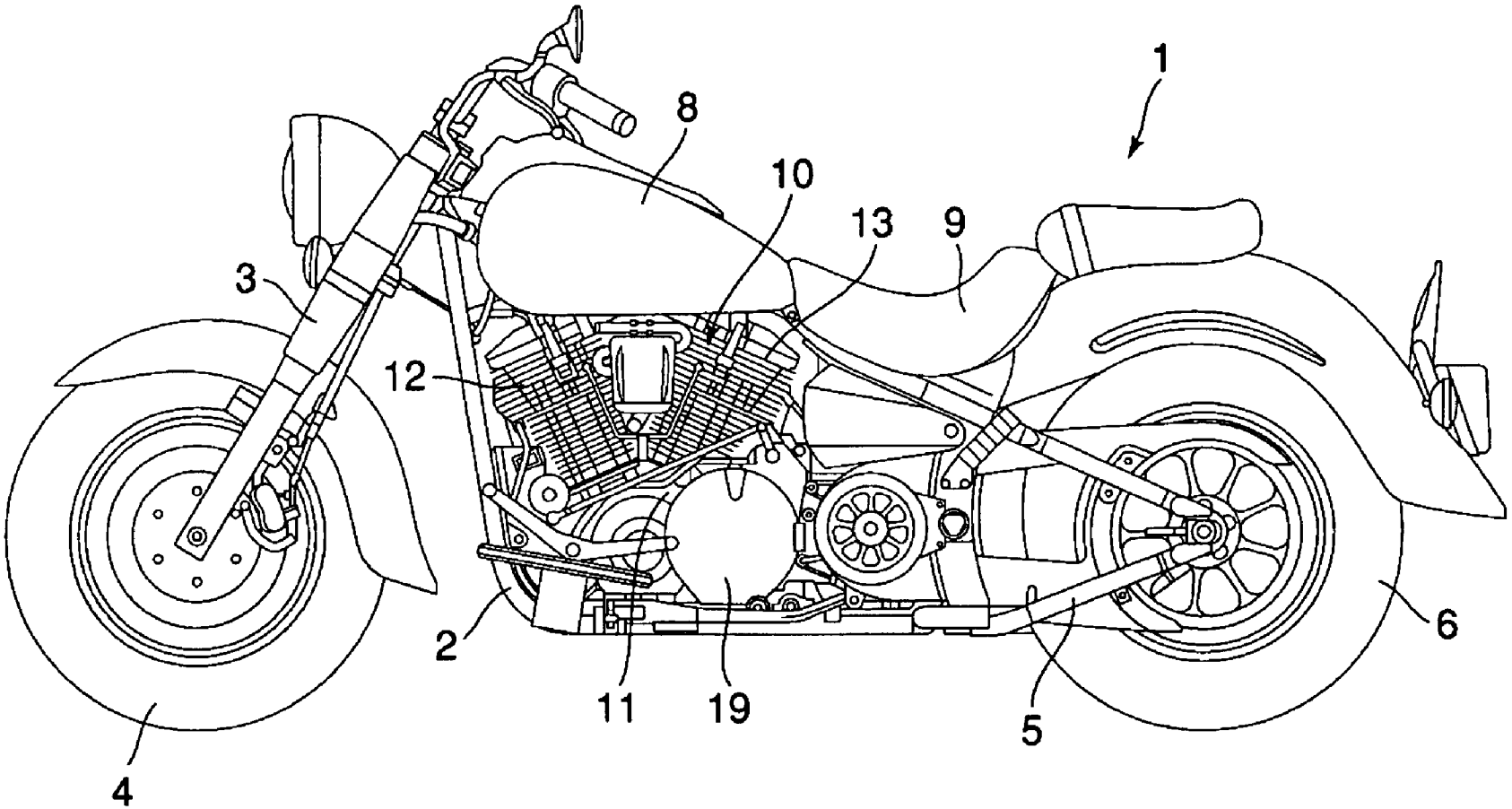
FIG. 1 is a side view of a motorcycle mounted with a dry-sump, air-cooled four-stroke V-type two-cylinder engine of a first embodiment of the present invention.

FIG. 1 is a drawing showing a motorcycle 1 relating to an embodiment of the present invention. The motorcycle 1 includes a cradle frame 2. A front fork 3 is attached to the front end of the frame 2. The front fork 3 supports the front wheel 4. A rear swing arm 5 is attached to the roar end of this frame 2. This rear spring arm 5 supports the rear wheel 6.

The frame 2 supports a fuel tank 8, a seat 9 and a dry-sump air-cooled four-stroke V-type two-cylinder engine 10. This engine 10 is installed, between the front wheel 4 and rear wheel 6 as well as below the fuel tank 8.

Figure 2:
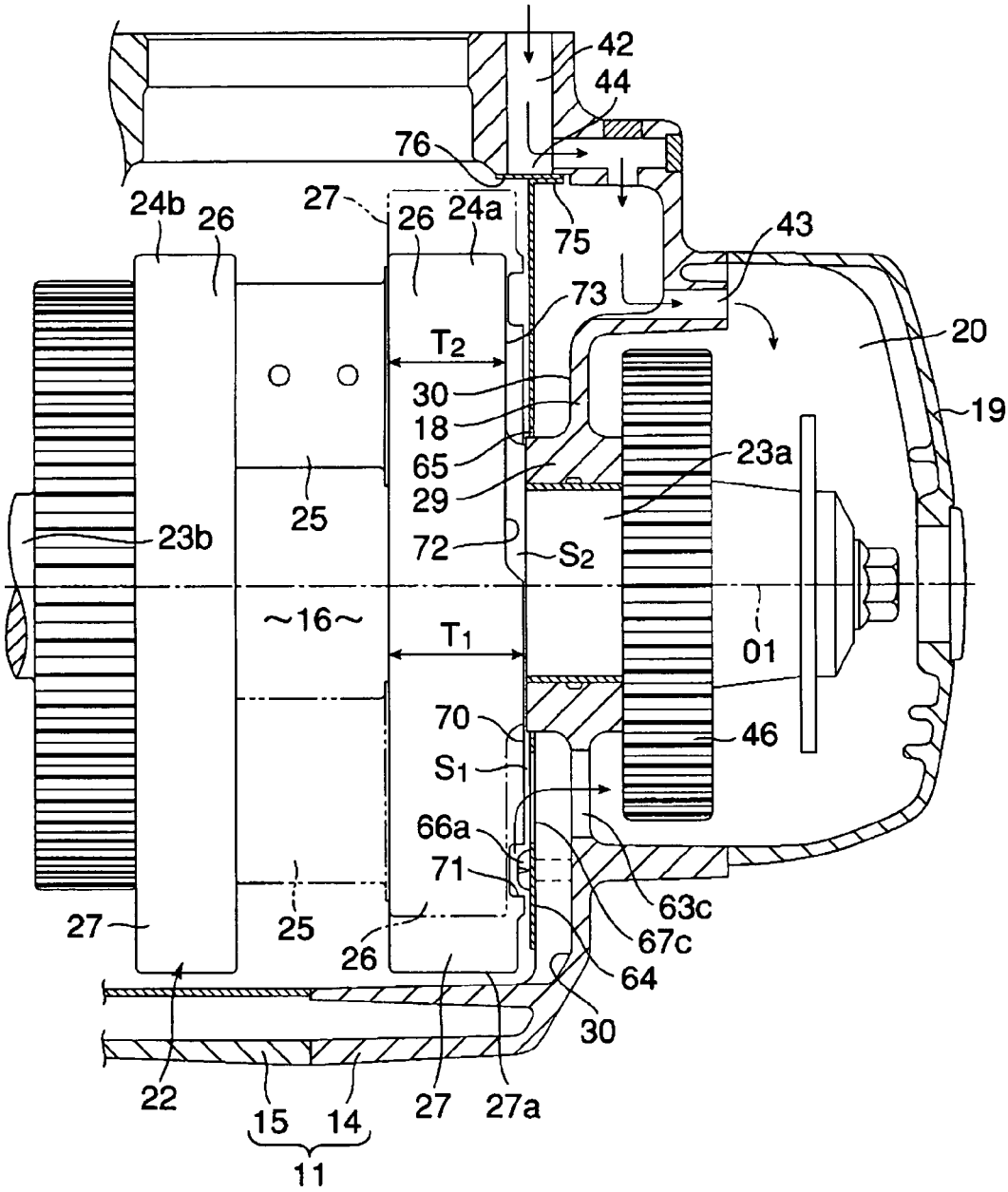
FIG. 2 is a cross sectional view of a crankcase showing a positional relationship of a partition plate and a crank web of a crankshaft of the first embodiment of the present invention.

The engine 10 includes a crankcase 11, a front cylinder 12 and a rear cylinder 13. The crankcase 11, as shown in FIG. 2, is separated into a left case 14 and a right case 15. A crank chamber 16 and a transmission chamber 17 are formed between the left case 14 and the right case 15. The crank chamber 16 does not have an effective oil pan protruding downward to the bottom. The bottom surface of the crank chamber 16 is therefore flat. The transmission chamber 17 is positioned rearwards of the crank chamber 16 and is also connected to the crank chamber 16.

The left case 14 contains a sidewall 18 forming the left side surface of the crank chamber 16. A clutch cover 19 is affixed to the outer circumferential section of this sidewall 18. Between this clutch cover 19 and the sidewall 18 forms a separate chamber or a clutch chamber 20. The clutch chamber 20 adjoins the crank chamber 16 with the sidewall 18 in between them.

The crank chamber 16, as shown in FIG. 2, holds one crankshaft 22. The crankshaft 22 contains a pair of journals 23*a*, 23*b*, a pair of crank webs 24*a*, 24*b*, and a crank pin 25. The journals 23*a*, 23*b* are positioned on both ends of the crankshaft 22, and are positioned along axial line 01 forming the rotational centerline of this crankshaft 22.

Figure 5:
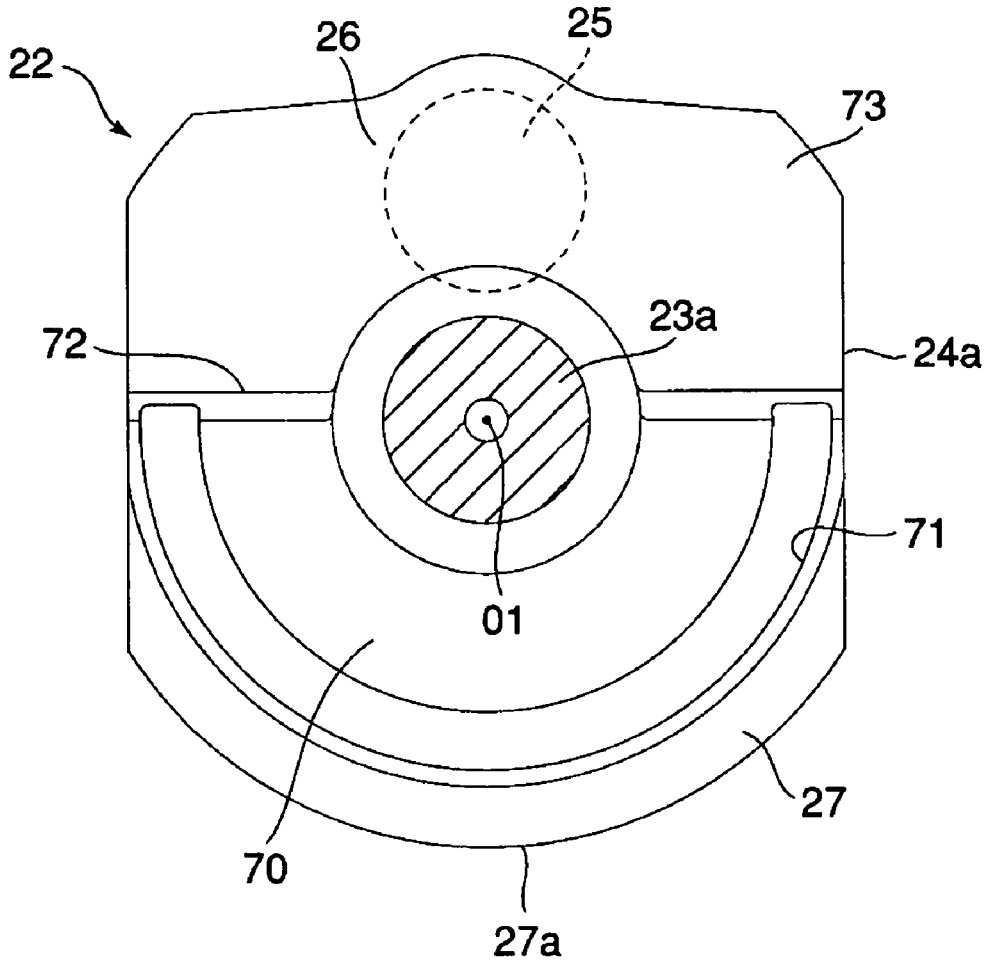
FIG. 5 is a cross sectional view of the crankshaft of the first embodiment of the present invention showing the state of the crank web.

As can be seen in FIG. 2 and FIG. 5, the crank webs 24*a*, 24*b* each contains a pin link section 26 and a balance weight section 27. The pin link section 26 forms an eccentric for the journals 23*a*, 23*b*. The balance weight section 27 projects toward the opposite side of the pin link section 26 relative to the axial line 01 of the crankshaft 22. The pin link section 26 of the present embodiment is designed to increase the inertial mass of the crank webs 24*a*, 24*b* and therefore forms an angular shape projecting to the outer side of the crank pin 25. The pin link section has width dimensions identical to the balance weight section 27.

To further increase the inertial mass of the crank webs 24*a*, 24*b*, the balance weight section 27 is formed to project by a large amount from the axial line 01 of crankshaft 22. A portion of the outer circumferential surface of this balance weight section 27 is formed in an arc shape as a curved surface 27*a*.

Figure 3:
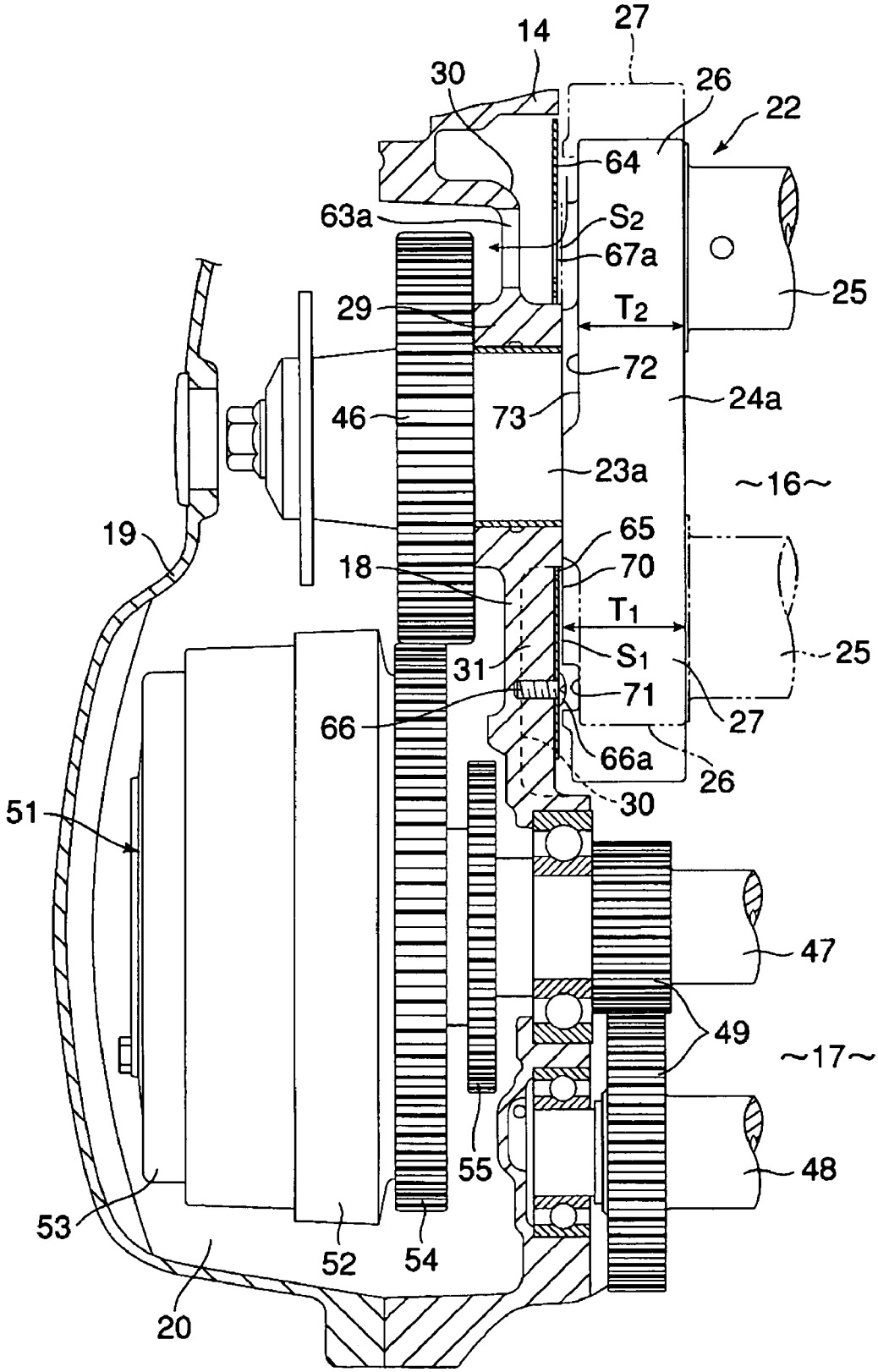
FIG. 3 is a cross sectional view of the crankcase showing a positional relationship of a clutch chamber and a crank chamber of the first embodiment of the present invention.
Figure 4:
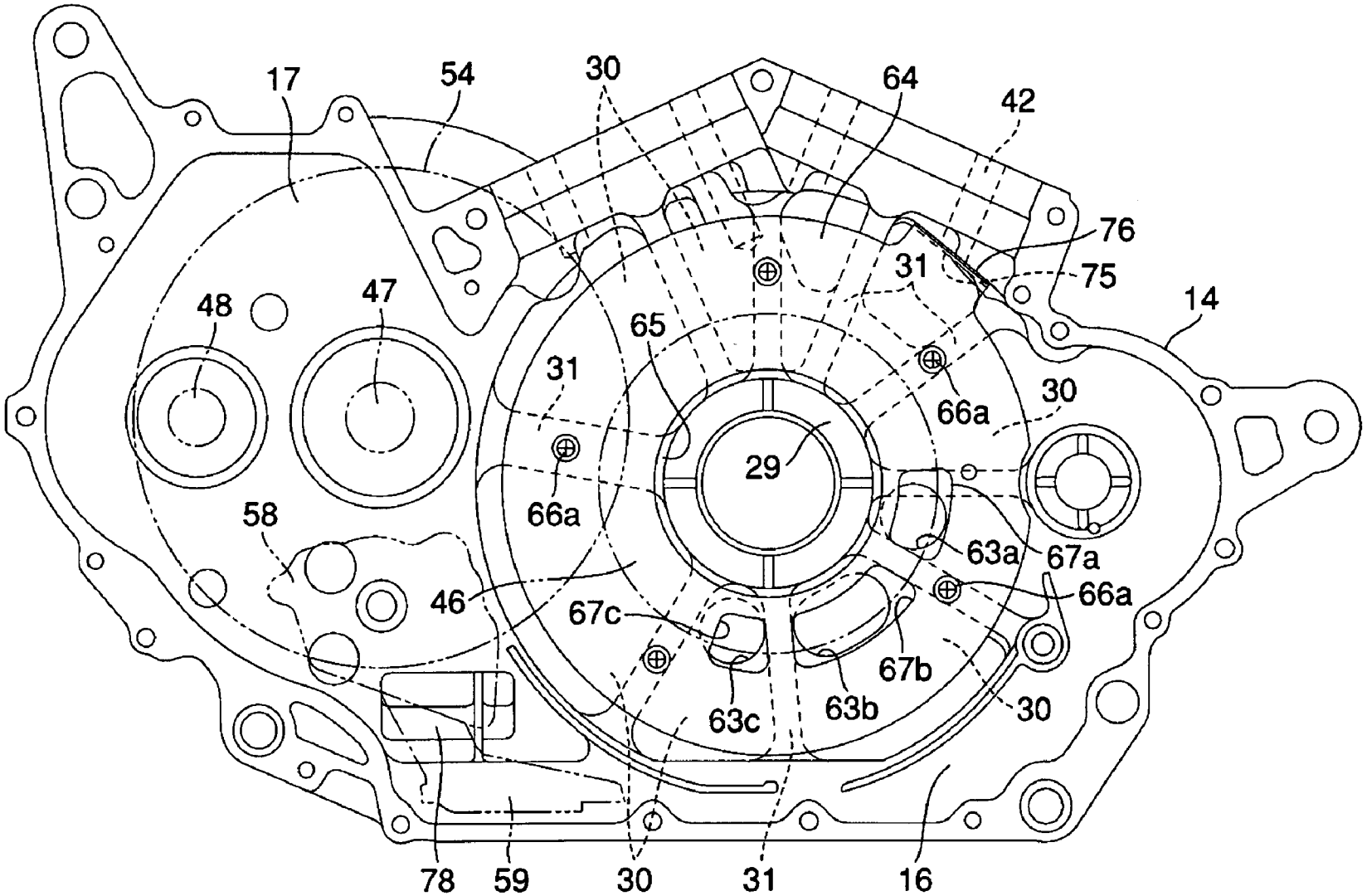
FIG. 4 is a side view of the left case of the crankcase showing the state where a concavity of a sidewall and passage holes are covered by the partition plate in the first embodiment of the present invention.

As shown in FIG. 2 through FIG. 4, multiple concavities 30 and a bearing 29 in the sidewall 18 form one shape. The bearing 29 forms a hollow cylindrical shape, and supports the journal section 23*a* on the left end of the crankshaft 22 to allow free rotation of movement. The concavities 30 have the purpose of reinforcing the bearing 29 and are positioned at intervals on its periphery so as to enclose this bearing 29. These concavities 30 further open toward the crank chamber 16 and face the crank web 24*a* on the left side of the crankshaft 22. The adjoining concavities 30 therefore form multiple ribs 31 on the sidewall 18. These ribs 31 extend radially from the bearing 29.

Figure 8:
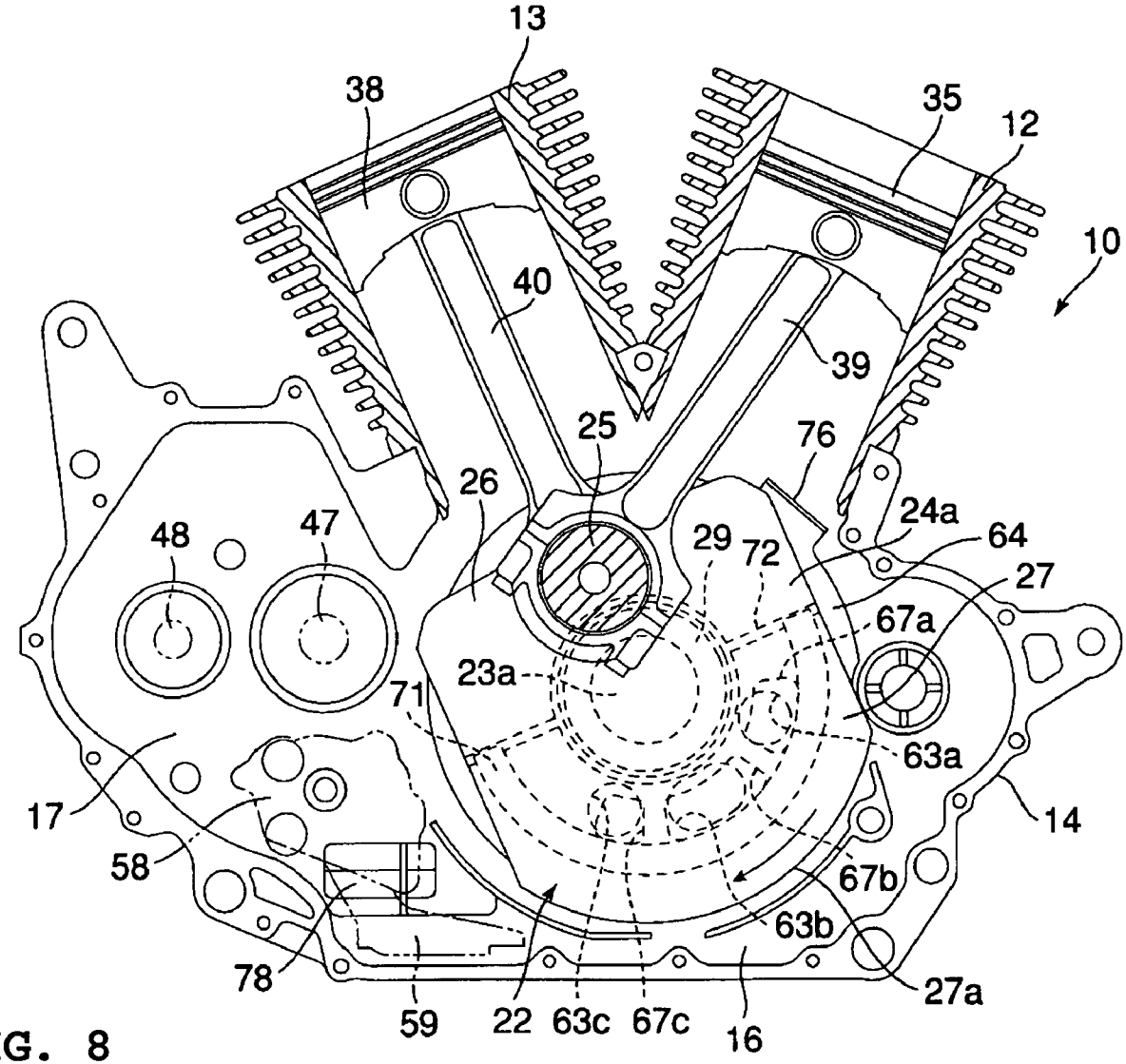
FIG. 8 is a cross sectional view showing a positional relationship between the through holes and the crank web when a piston of a rear cylinder is at a top dead center position in the air-cooled four-stroke V-type two-cylinder engine of the first embodiment of the present invention.

As shown in FIG. 1 and FIG. 8, the front cylinder 12 of the engine 10 extends obliquely upward from the upper surface of the crankcase 11. This front cylinder 12 holds one piston 35. The rear cylinder 13 of engine 10 extends obliquely rearward and upward from the upper surface of the crankcase 11. This rear cylinder 13 holds one piston 38.

The piston 35 of front cylinder 12 and the piston 38 of the rear cylinder 13 are each coupled by way of connecting rods 39, 40 to the common crank pin 26 of the crankshaft 22. In the case of the present embodiment, the angle between the front cylinder 12 and rear cylinder 13, that is, a V-bank angle, is sot for example to 48 degrees. The pistons 35, 38 of the front cylinder 12 and rear cylinder 13) respectively, therefore move back and forth at approximately the same time. The crankshaft 22 is driven by this reciprocating (back and forth) movement of these pistons 35, 38. As shown by the arrow in FIG. 8, the crankshaft 22 rotates forward in the direction of the rotation of front wheel 4 while the motorcycle 1 is moving forward.

As shown in FIG. 2, an oil return path 42 is formed in the left case 14 of the crankcase 11. The oil return path 42 has the task of returning lubricant oil that lubricated the front cylinder 12 valve mechanism (not shown in drawing to the crank chamber 16. The downstream end of this oil return path 42 is open onto the upper surface of one concavity 30 positioned directly above the bearing 29. The one concavity 30 that opens to the oil return path 42 is connected by way of an oil circulating hole 43 to the clutch chamber 20. This oil circulating hole 43 is positioned lower than the downstream end of the oil return path 42.

The oil return path 42 contains an opening 44 that opens onto the crank chamber 16. This opening 44 is positioned further upstream than the downstream end of the oil return path 42, while being positioned directly above the crank web 24*a* precisely on the left side.

As shown in FIG. 2 and FIG. 3, the journal section 23*a* on the left end of crankshaft 22 is inserted into the clutch chamber 20. A small reduction gear 46 is clamped onto the inserted portion of this journal 23*a*. A first and a second transmission shaft 47, 48 are housed in the transmission chamber 17 of the crankcase 11. The first and second transmission shafts 47, 48 are installed parallel with the crankshaft 22. A transmission gear train 49 is affixed on these transmission shafts 47, 48.

The first transmission shaft 47 is connected to the crankshaft 22 by a wet typo clutch 51. This wet type clutch 51 is immersed in lubricant oil contained in clutch chamber 20. This wet type clutch 51 contains a clutch housing 52 positioned on the input end of a motive force, and a clutch boss 53 positioned on the output end of the motive force. A large reduction gear 54 and a pump drive gear 55 are clamped to the clutch housing 52. The large reduction gear 54 engages with the small reduction gear 46 to rotate with the crankshaft 22 as one unit. The clutch boss 53 is clamped to one end of the first transmission shaft 47. Multiple clutch plates and multiple friction plates are interposed between this clutch boas 53 and the clutch housing 52.

Figure 6:
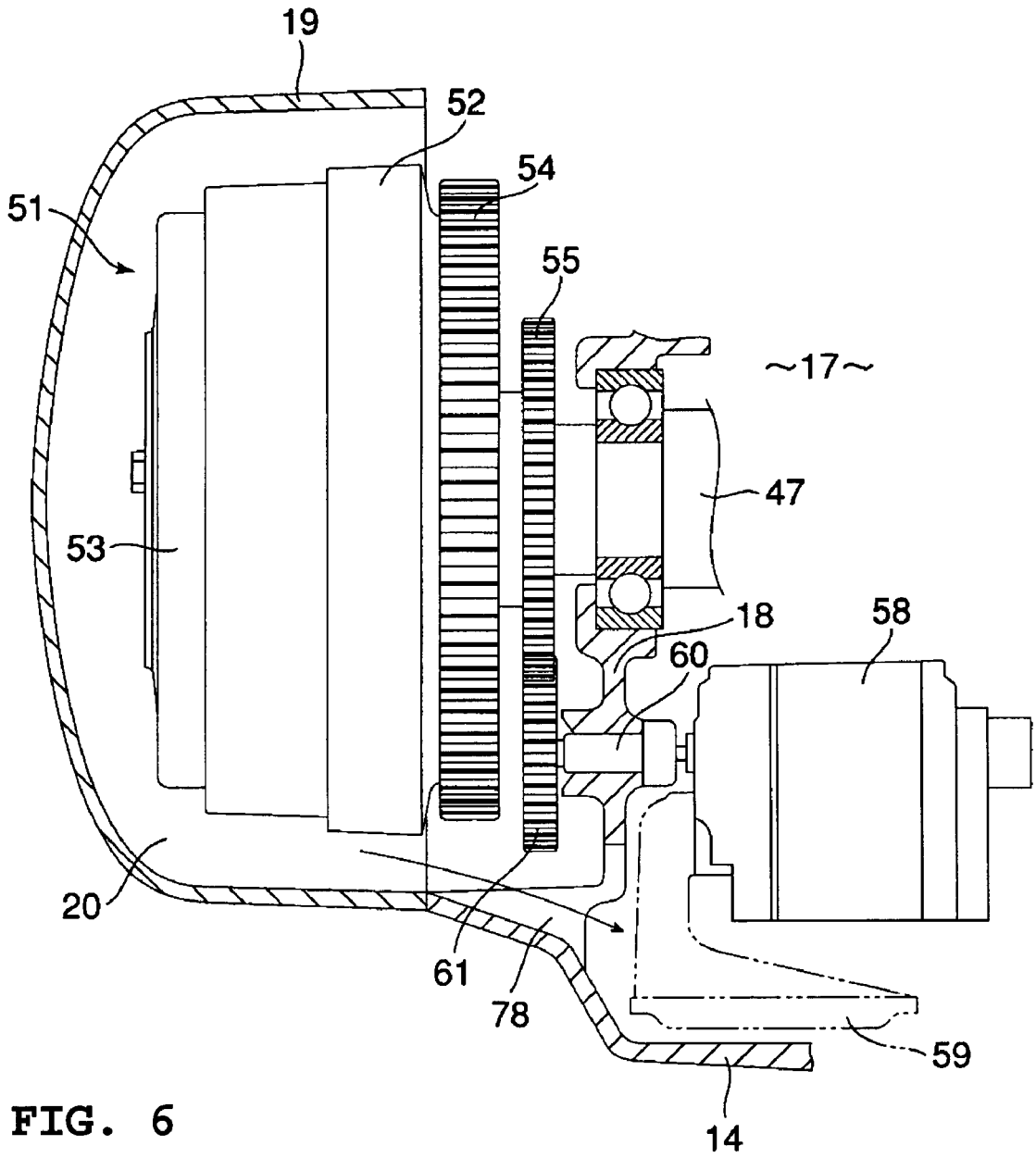
FIG. 6 is a cross sectional view of the crankcase showing a positional relationship of a wet type clutch and an oil pump.

An oil pump 58 is installed in the transmission chamber 17 as shown in FIG. 6. The oil pump 58 suctions up the lubricant oil from the bottom of the crank chamber 16. The oil pump 58 also returns this suctioned-up lubricant oil to an oil tank (not shown in the drawing). The oil pump 58 contains an oil strainer 59 for suctioning up the lubricant oil. This oil strainer 59 is stored at the rear of the crank chamber 16, and faces the bottom surface of the crank chamber 16.

The oil pump 58 contains a drive shaft 60 to rotate the impeller. The drive shaft 60 fits into the clutch chamber 20 through the sidewall 18 of the left case 14. The section of this drive shaft 60 inside the clutch chamber 20 is clamped to a slave gear 61. This slave gear 61 engages with the pump drive gear 55.

Three passage holes 63*a*, 63*b*, 63*c* are formed in the sidewall 18 of the crankcase 11 as shown in FIG. 4. The three passage holes 63*a*, 68*b*, 63*c* are installed in an area from the lower section to the front section of the bearing 29 and are arrayed at intervals on the periphery of the bearing 29 to correspond to the concavities 30 positioned at spaced intervals. In other words, the passage holes 63*a*, 63*b*, 63*c* open onto three concavities 30 and are formed in the sidewall 18 to connect these concavities 30 and the clutch chamber 20. These passage holes 63*a*, 63*b*, 63*c* are formed in a position overlapping the crank web 24*a* of this crankshaft 22 as seen axially along the crankshaft 22.

The open end of the concavities 30 facing the crank chamber 16 and the passage holes 63*a*, 63*b*, 63*c* are covered by a metal partition plate 64. This partition plate 64 forms a large disk corresponding to the crank web 24*a*. A hole 65 is formed at the center of this disk to avoid the bearing 29. This partition plate 64 is clamped by multiple screws 66 to the ribs 31 of sidewall 18. This functions as a divider wall between the crank chamber 16 and the clutch chamber 20. The crank chamber 16 and the clutch chamber 20 in this way adjoin each other with the partition plate 64 interposed in between them.

Figure 7:
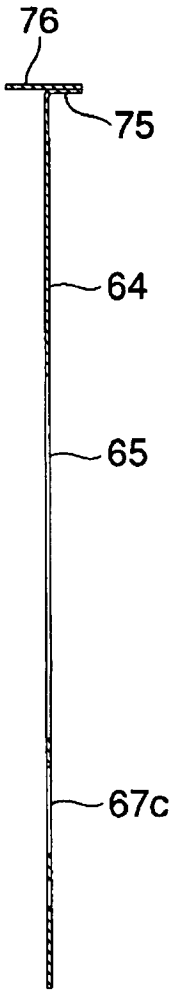
FIG. 7(A) is a frontal view of the partition plate of the first embodiment of the present invention and FIG. 7(B) is a cross sectional view taken along lines F7—F7 of FIG. 7(A).
Figure 7:
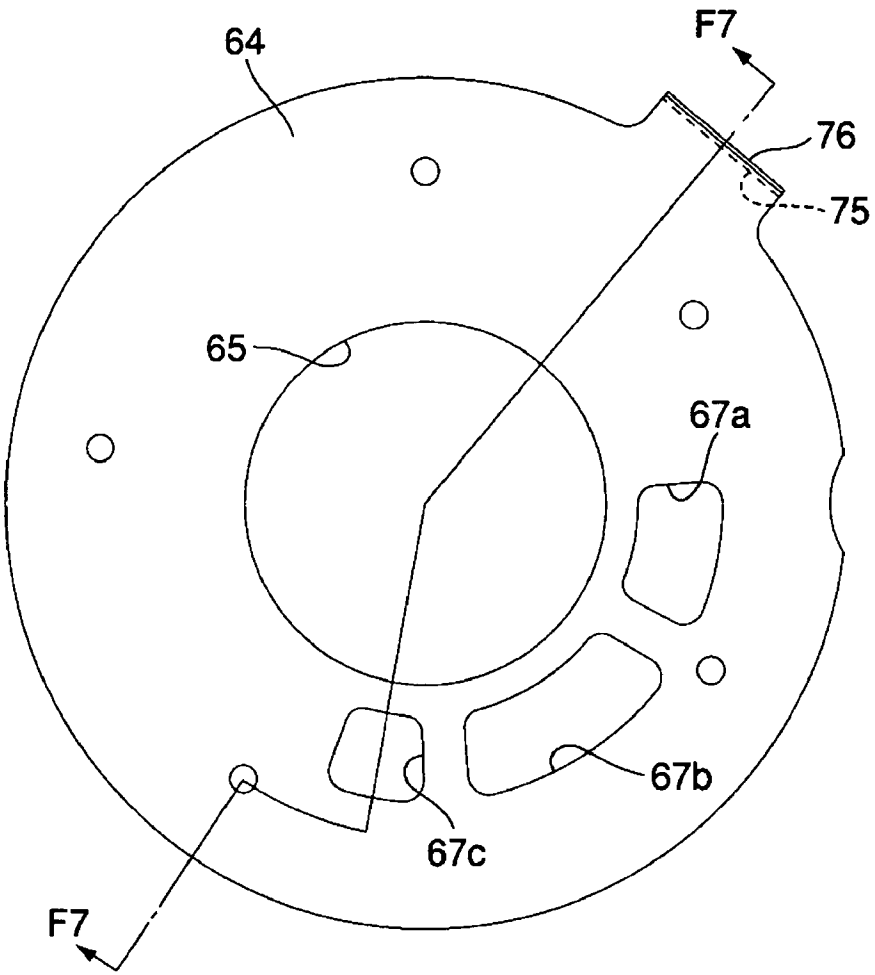

As shown in FIG. 4 and FIG. 7, the partition plate 64 contains three through holes 67*a*, 67*b*, 67*c*. These three through holes 67*a*, 67*b*, 67*c* are arrayed at spaced intervals around one side of the periphery of the partition plate 64, and face the passage holes 63*a*, 63*b*, 63*c* when viewing the partition plate 64 along the axis of the crankshaft 22. The crank chamber 16 therefore connects to the clutch chamber 20 by way of the passage holes 63*a*, 63*b*, 63*c* and the through holes 67*a*, 67*b*, 67*c*.

The partition plate 64 adjoins the left side of the crank web 24*a* of the crankshaft 22 as shown in FIG. 2 and FIG. 3. The crank web 24*a* is formed such that the plate thickness T1 of its balance weight 27 is thicker than the plate thickness T2 of the pin link section 26. The balance weight 27 is in other words formed by a thick plate section of the crank web 24*a*. This balance weight 27 contains a flat side surface 70 facing the partition plate 64. A first gap S1 is formed between this side surface 70 and the partition plate 64. The size of the fist gap S1 is extremely small and as close to 0 as possible.

A head section 66*a* of the screw 66 affixing the partition plate 64 to the sidewall 18, protrudes into the crank chamber 16. The extent of the protrusion exceeds the first gap S1. A groove 71 is therefore formed for the head section 66*a* of the screw 66 in the side surface 70 of the crank web 24*a*. This groove 71 is formed in an are centering on the axial line 01 of the crankshaft 22.

The pin link section 26 contains a thin plate section formed on the crank web 24*a*. This pin link section 26 contains a recess 72 in a direction farther from the partition plate 64 than the side surface 70 of the balance weight 27. The amount of the concavity of the recess 72 exceeds the amount that the head section 66*a* of the screw 66 protrudes. A flat side surface 73 of this recess 72 faces the partition plate 64. A second gap S2 is formed between the partition plate 64 and the side surface 73 of the recess 72. The second gap S2 is formed slightly larger than the first gap S1 in order to obtain a smooth flow of gas within the crank chamber 16.

Therefore at a point in time when the side surface 70 of the balance weight 27 faces the through holes 67*a*, 67*b*, 67*c* of the partition plate 64 along with the rotation of the crankshaft 22, the side surface 70 of the balance weight 27 is formed to close the through holes 67*a*, 67*b*, 67*c* as shown in FIG. 2. The connection between the crank chamber 10 and the clutch chamber 20 is therefore blocked.

In contrast, as shown in FIG. 3, at a point in time when the side surface 73 of the recess 72 of the pin link section 26 faces the through holes 67*a*, 67*b*, 67*c* of the partition plate 64, the side surface 73 of the recess 72 moves further away from the through holes 67*a*, 67*b*, 67*c* so that these through holes 67*a*, 67*b*, 67*c* are opened to the crank chamber 16. The crank chamber 16 and the clutch chamber 20 are therefore maintained in a mutually connected state.

As shown in FIG. 2, the outer circumferential edge on the upper end of the partition plate 64 is positioned directly below the opening 44 of the oil return path 42. A flange 75 bent back at a right angle is formed on the outer circumferential edge of this partition plate 64. A sealing plate 76 functioning as a seal is affixed on this flange 75. The sealing plate 76 scale the opening 44 of the oil return path 42 from the inner side of the crank chamber 16.

A return hole 78 is formed in the sidewall 18 of the left case 14 as shown in FIG. 4 and FIG. 6. The return hole 78 is more to the rear than the crankshaft 22 as seen along the axis of crankshaft 22. The return hole 78 is also at a position further downward than the through holes 67*a*, 67*b*, 67*c*, and separate from the crank web 24*a* of the crankshaft 22. The crank chamber 16 is therefore permanently connected to the clutch chamber 20 through the return hole 78. An oil strainer 59 is positioned in the vicinity of this return hole 78.

The operation of the air-cooled four-stroke V-type two-cylinder engine 10 configured as above is described next while, referring to FIG. 8 through FIG. 11.

FIG. 8 shows the piston 38 of the rear cylinder 13 positioned at a top dead center position, and the piston 35 of the front cylinder 12 positioned just before a top dead center position. The crank pin 25 of the crankshaft 22 is positioned higher at this time than the journal section 23*a*. The balance weight 27 of the crank web 24*a* at this time projects below the journal section 23*a*. The side surface 70 of the balance weight 27 therefore faces the through holes 67*a*, 67*b*, 67*c* of partition plate 64 with the first gap S1 interposed in between them. The first gap S1 is as near 0 as possible so the side surface 70 of the balance weight 27 essentially blocks the through holes 67*a*, 67*b*, 67*c*. The connection between the crank chamber 16 and the clutch chamber 20 is therefore blocked.

Figure 9:
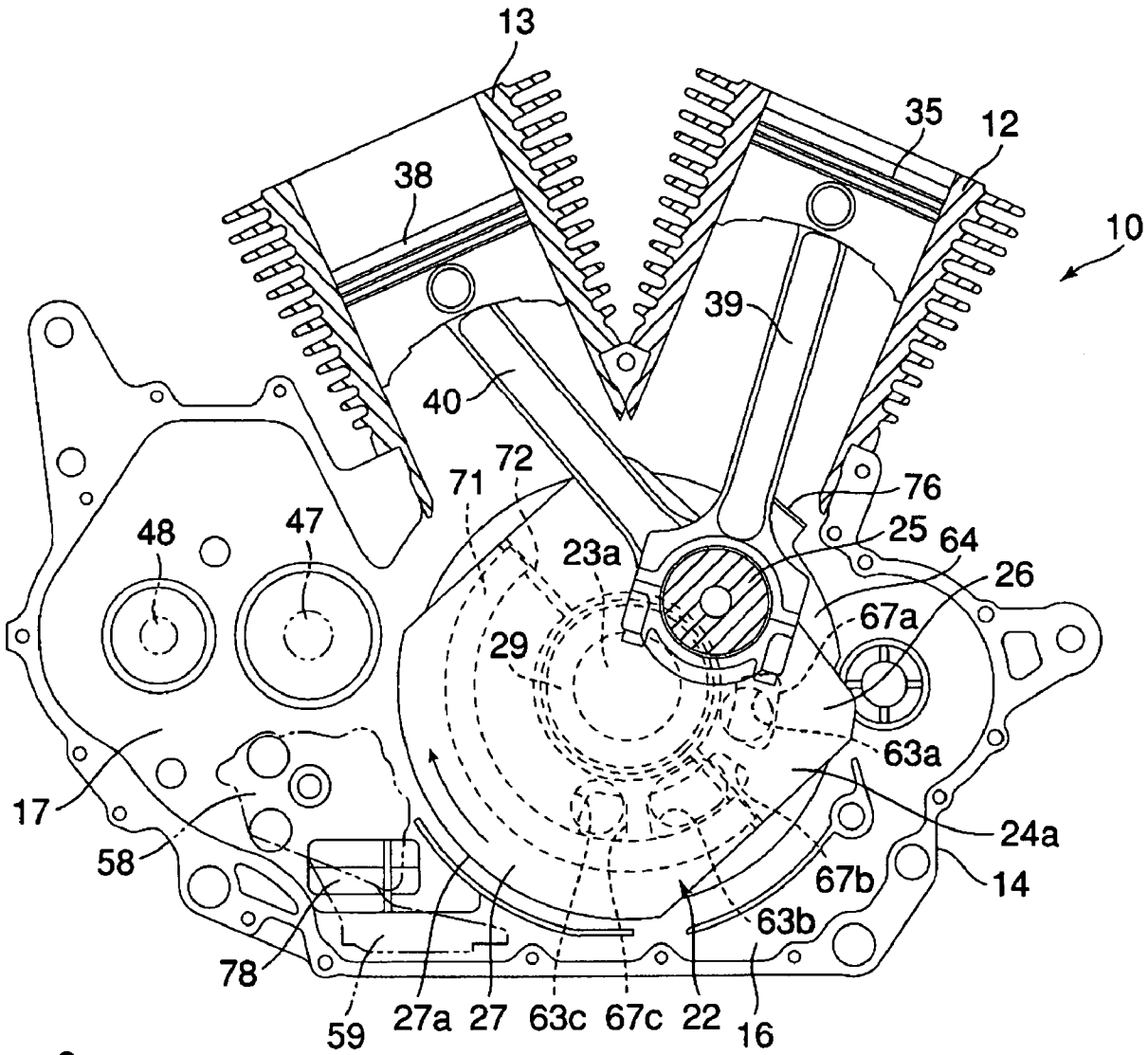
FIG. 9 is a cross sectional view showing a positional relationship between the through holes and the crank web when the piston of the rear cylinder falls from the top dead center position to a bottom dead center position in the air-cooled four-stroke V-type two-cylinder engine of the first embodiment of the present invention.

FIG. 9 shows the process of the pistons 35, 38 of the front and rear cylinders 12, 13 moving from the top dead center position toward the bottom dead center position. When the piston 38 of the rear cylinder 13 arrives at the intermediate position (for example, 72 degrees after the top dead center position) between the top dead center position and the bottom dead center position, the pin link section 26 thinner than the balance weight 27, faces the through holes 67*a* positioned on the front side of the bearing 29.

Figure 10:
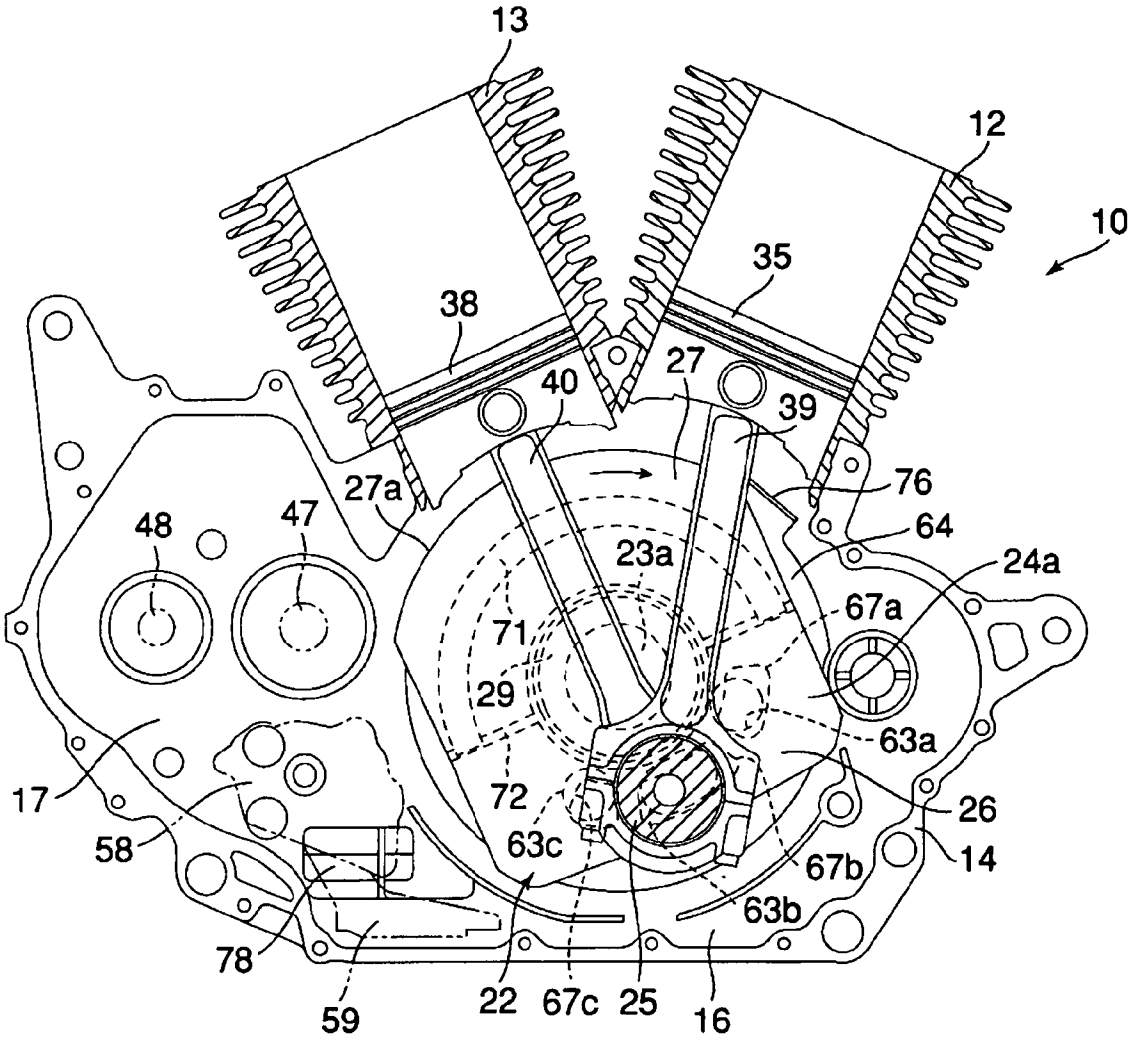
FIG. 10 is a cross sectional view showing the positional relationship between the through holes and the crank web when the piston of the rear cylinder is at the bottom dead center position in the air-cooled four-stroke V-type two-cylinder engine of the first embodiment of the present invention.

When the piston 38 of the roar cylinder 18 reaches the bottom dead center position as shown in FIG. 10, the thin pin link section 26 of the crank web 24*a* faces all the through holes 67*a*, 67*b*, 67*c*. In other words, a second gap S2 of a size large enough to allow the passage of gas, is interposed between the through holes 67*a*, 67*b*, 67*c*, and the sidewall 78 of recess 72 of the pin link section 26. The through holes 67*a*, 67*b*, 67*c* are therefore exposed by way of the second gap S2, to the crank chamber 16.

Therefore during the period that a positive pressure is generated in the crank chamber 16 as the pistons 35, 38 move downward, the gas within the crank chamber 16 pressurized by the pistons 35, 38 is pressed out, an shown by the arrow in FIG. 3, through the through holes 67*a*, 67*b*, 67*c* and the passage holes 63*a*, 63*b*, 63*c* to the clutch chamber 20.

Along with this action, while the pistons 35, 38 move downward, the curved surface 27*a* of the outer circumferential surface of the crank web 24*a* nears the bottom of the crank chamber 16, and the gap between the curved surface 24*a* and the bottom of crank chamber 16 narrows. The lubricant oil in the vicinity of the crank web 24*a* receives the effect of the air pressure accompanying the fall of the pistons 35, 38 and is blown away. This lubricant oil then flows along with the gas inside the clutch chamber 16 and flows by way of the through holes 67*a*, 67*b*, 67*c* and the passage holes 63*a*, 63*b*, 63*c* into the clutch chamber 20.

Figure 11:
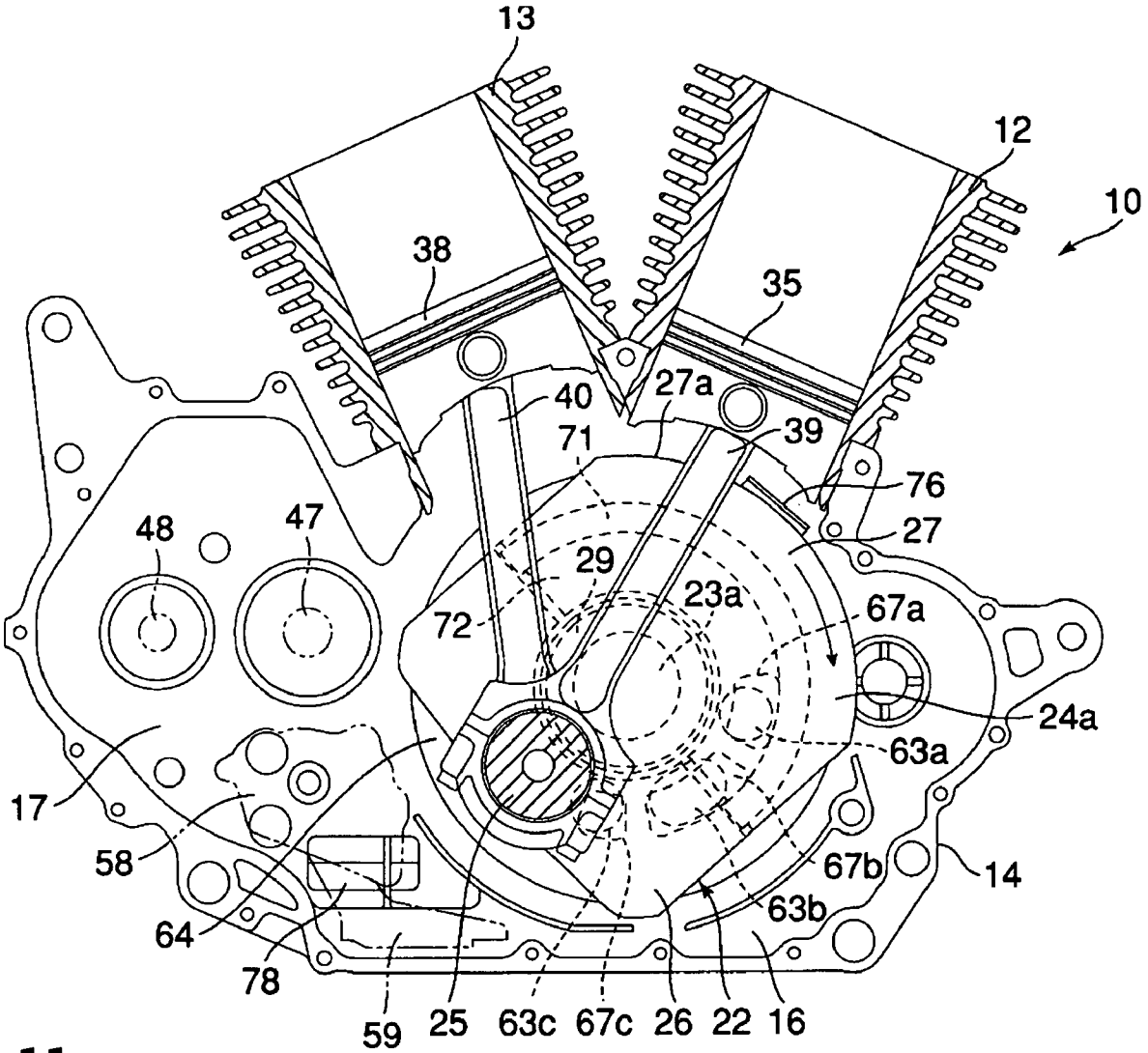
FIG. 11 is a cross sectional view showing the positional relationship between the through holes and the crank web when the piston of the rear cylinder rises in the air-cooled four-stroke V-type two-cylinder engine of the first embodiment of the present invention.

When the piston 38 of the rear cylinder 13 is at for example 72 degrees after the bottom dead center position as shown in FIG. 11, the side surface 70 of the balance weight 27 of the crank web 24*a* overlaps the through hole 67*a* and blocks the through hole 67*a*. All the through holes 67*a*, 67*b*, 67*c* are blocked in the stroke by the side surface 70 of the balance weight 27 until the piston 38 of the rear cylinder 13 reaches the top dead center position.

From the above actions, at the point in time that a negative pressure acts on the crank chamber 16 along with the rise of the pistons 35, 38, the crank web 24*a* reaches a state that it successively blocks the through holes 67*a*, 67*b*, 67*c*. This crank web 24*a* and through holes 67*a*, 67*b*, 67*c* function as check valves. The pressure differential is therefore maintained between the crank chamber 16 and the clutch chamber 20, and a negative pressure acts on the permanently opened return hole 78.

Consequently, the lubricant oil, pressed out of the crank chamber 16 into the clutch chamber 20 when the pistons 35, 38 fall, is therefore efficiently suctioned up from the return hole 78 by the pressure fluctuation within the crank chamber 16. The lubricant oil from there, then flows into the vicinity of the oil strainer 59 installed within the crank chamber 16.

The oil pump 58 suctions up the lubricant oil that returned from the crank chamber 16 via the oil strainer 59. After the suctioned-up lubricant oil is returned to the oil pump 58 and the oil tank (not shown in the drawing), the oil is then supplied for example, to the bearing of the crankshaft 22 or to the valve mechanisms of the front and rear cylinders 12, 13.

In the first embodiment of the present invention, the balance weight 27 of crank web 24*a* blocks the through holes 67*a*, 67*b*, 67*c* at the point in time that the pistons 35, 38 move from the bottom dead center position toward the top dead center position. The crank web 24*a* and the through holes 67*a*, 67*b*, 67*c* therefore function as a check valve to block the connection between the clutch chamber 20 and the crank chamber 16. The pressure differential is maintained between the clutch chamber 20 and the crank chamber 16.

The lubricant oil pressed out of the crank chamber 16 into the clutch chamber 20 is therefore reliably recovered without having to utilize complex and expensive parts such as reed valves. Therefore while using a simple structure, an increased number of parts can be prevented. Further, no design changes for the crankcase 11 are required and costs can be reduced.

The above structure further makes it difficult for surplus oil to accumulate in the clutch chamber 20 so that a rise in the lubricant oil fluid level within the clutch chamber 20 can be prevented. The agitation resistance to lubricant oil from the wet-type clutch 51 can therefore be suppressed.

The partition 64 covers the multiple concavities 30 opening onto the clutch chamber 16, so that lubricant oil blowing out during the fall of the pistons 36, 38 is prevented from flowing into the concavities 30, and the accumulation of oil is avoided. Therefore, along with a satisfactory return of lubricant oil from the clutch chamber 20, the amount of oil, not contributing to engine lubrication, but already accumulated in the clutch chamber 20 and the concavities 30, is small.

There is therefore no need to add extra lubricant oil to compensate for the accumulated portion of oil (in the engine). Also, besides reducing the size of the oil tank, the lubricant oil filling capacity can be reduced so that the engine 10 can be made lighter in weight.

The partition plate 64 further contains a sealing plate 76 for sealing the opening 44 of the oil return path 42 in this external periphery. The rise in pressure within the crank chamber 16 at this point in time that in particular accompanies the fall of the pistons 35, 38 is therefore not conveyed as pressure within the crank chamber 16 on the oil return path 42. In other words, the lubricant nil returning to the crankcase 11 by way of the oil return path 42, can prevent from receiving the pressure within the crank chamber 16 and from being blown away.

The lubricant oil passing along the oil return path 42 consequently flows from the oil return path 42 into the concavities 30 as shown by the arrow in FIG. 2, and from here flows through the oil circulating hole 43 into the clutch chamber 20. Consequently the benefit is obtained that the lubricant oil returning from the front cylinder 12 can be reliably supplied to the clutch chamber 20.

The present invention is not limited to the first embodiment. The second embodiment of the present invention is described next while referring to FIG. 12 through FIG. 16.

The second embodiment differs from the first embodiment in which the shape of the crank web 24*a* of the crankshaft 22 is different. Other than the shape of the crank web 24*a*, the structure of the engine 10 is identical to the structure of the first embodiment. Components of the second embodiment identical to the first embodiment are therefore assigned the same reference numerals and their description is omitted.

Figure 12:
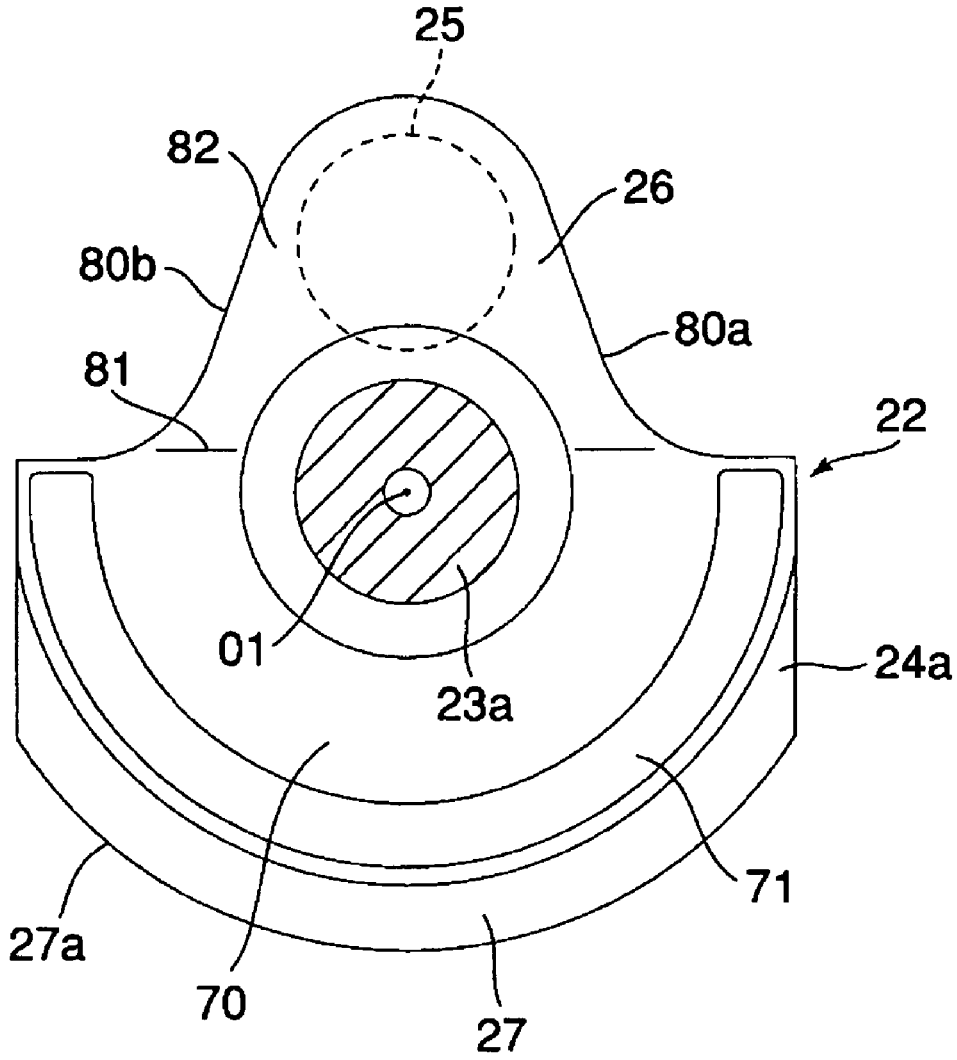
FIG. 12 is cross sectional view showing the shape of the crank web of a second embodiment of the present invention.

As shown in FIG. 12, the pin link section 26 of the crank web 24*a* is formed with a width narrower than the balance weight 27. In other words, the pin link section 26 contains a pair of escape sections 80*a*, 80*b* with notches to reduce the width dimension to less than that of the balance weight 27. These escape sections 80*a*, 80*b* are positioned on both sides of the pin link section 26 in its width direction and face each other with the crank pin 25 in between them.

The pin link section 26 further contains a recess 81 with a deeper cavity than the side surface 70 of the balance weight 27. The amount of recess of the recess 81 exceeds the amount that the head section 66*a* of the screw 66 protrudes. The flat side surface 82 of this recess 81 faces the partition plate 64. The pin link section 26 is therefore formed thinner than the thickness dimension of the balance weight 27.

Figure 13:
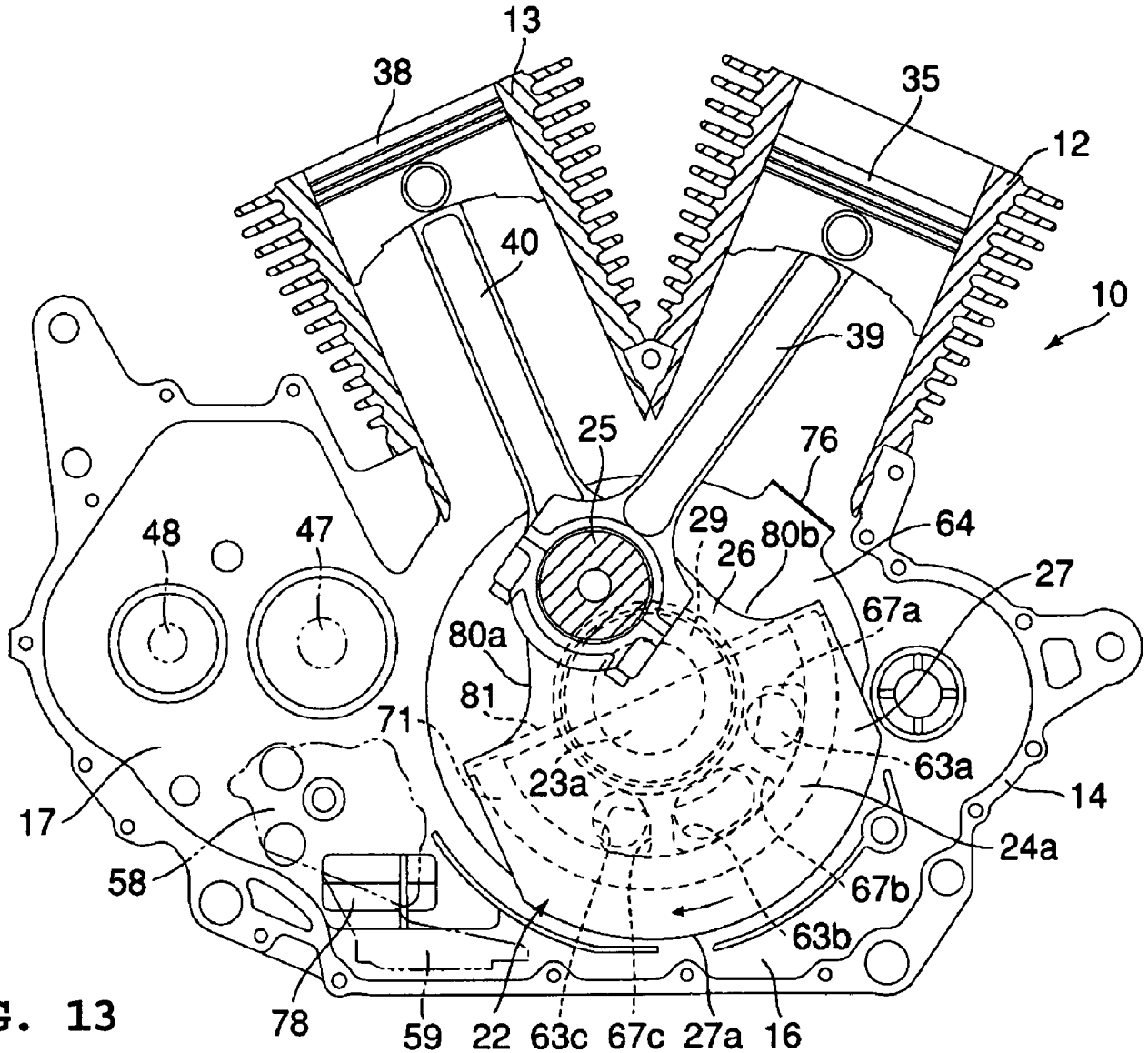
FIG. 13 is a cross sectional view showing a positional relationship between the through holes and a crank web when a piston of a rear cylinder is at the top dead center position in an air-cooled four-stroke V-type two-cylinder engine of the second embodiment of the present invention.

As shown in FIG. 13, the piston 38 of the rear cylinder 13 is positioned at the top dead center position, and the piston 35 of the front cylinder 12 is positioned just before the top dead center position. The balance weight 27 of the crank web 24*a* at this time is protruding below the journal section 23*b*. In the second embodiment, the through holes 67*a*, 67*b*, 67*c* of the partition plate 64 are blocked in the same manner as in the first embodiment.

Figure 14:
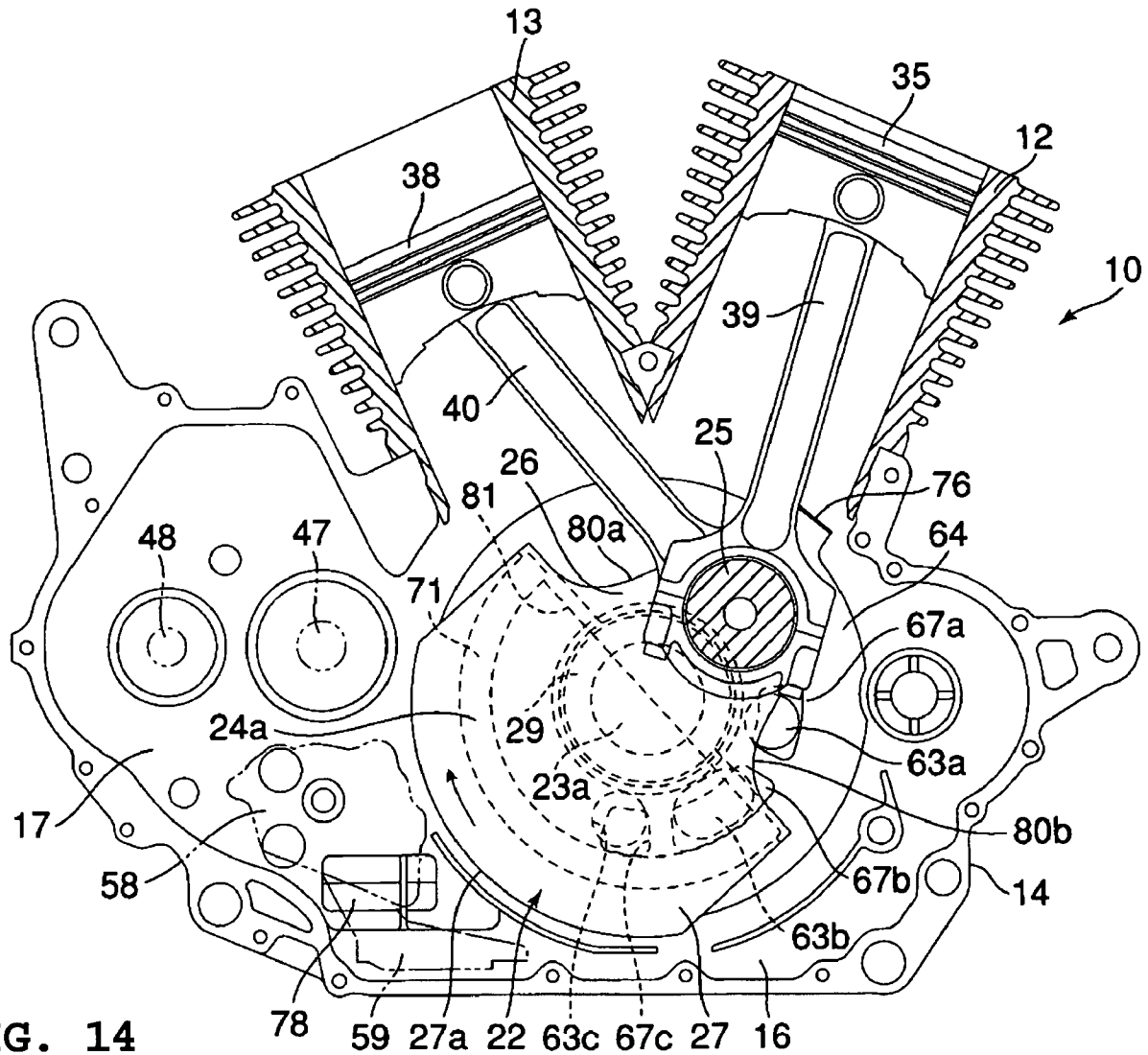
FIG. 14 is a cross sectional view showing the positional relationship between the through holes and the crank web when the piston of the rear cylinder falls from the top dead center position toward the bottom dead center position in the air-cooled four-stroke V-type two-cylinder engine of the second embodiment of the present invention.

FIG. 14 shows the stroke where the pistons 35, 38 of the front and rear cylinder 12, 13 move from the top dead center position toward the bottom dead center position. When the piston 38 of the rear cylinder 13 arrives at the intermediate position (for example, 72 degrees after the top dead center position) between the top dead center position and the bottom dead center position, then the pin link section 26 thinner than the balance weight 27, faces the though hole 67*a* positioned on the front side of the bearing 29. Along with this action, the escape section 80*a* of the pin link section 26 faces the through hole 67*a* and in this way exposes the through hole 67*a* to the crank chamber 16.

Figure 15:
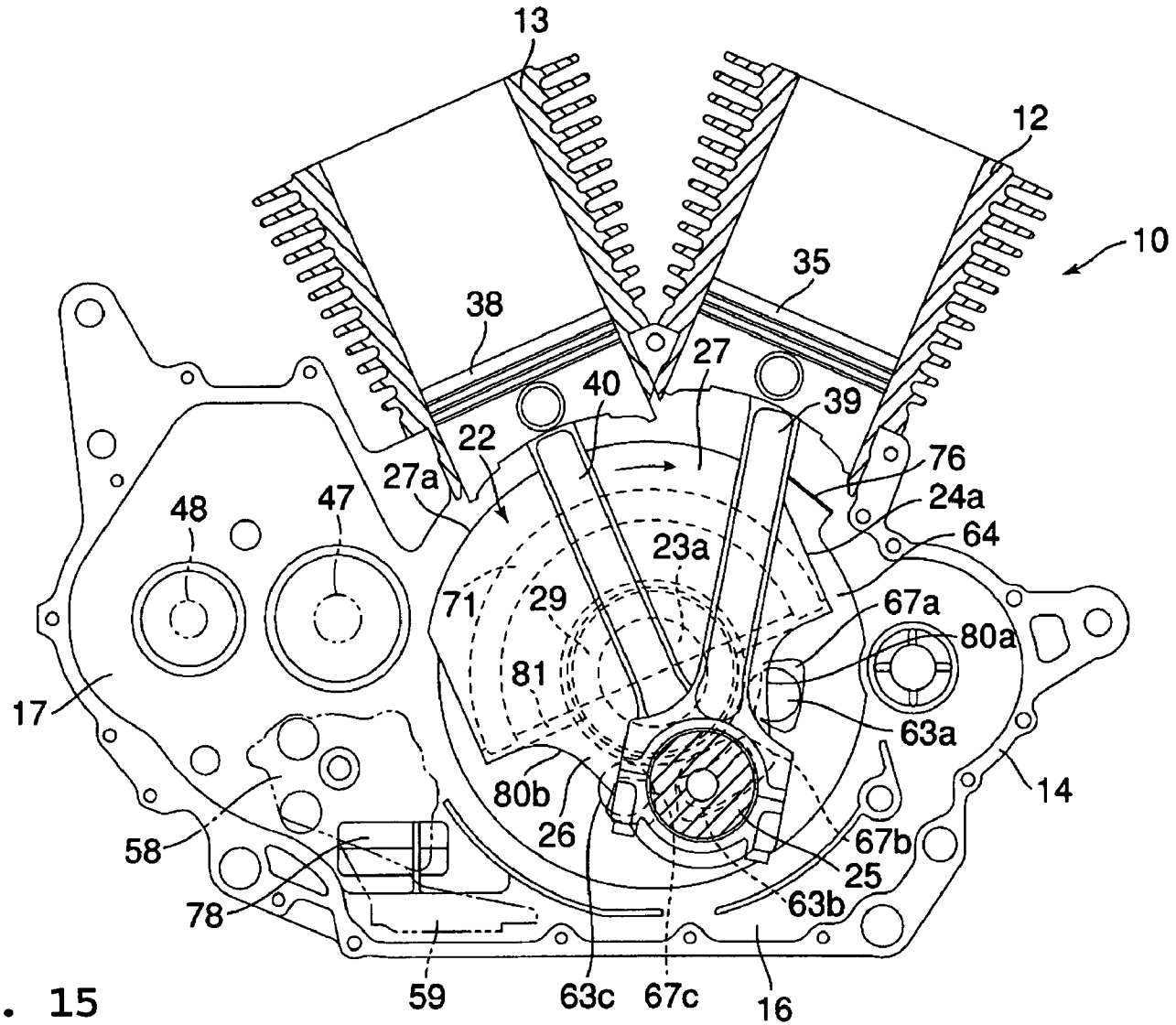
FIG. 15 is a cross sectional view showing the positional relationship between the through holes and the crank web when the piston of the rear cylinder is at the bottom dead center position in the air-cooled four-stroke V-type two-cylinder engine of the second embodiment of the present invention.

Further, as shown in FIG. 15, in the state where the piston 38 of the rear cylinder 13 is at the bottom dead center position, the thin pin link section 26 of the crank web 24*a* faces all the through holes 67*a*, 67*b*, 67*c*. Also the through holes 67*a*, 67*c* are exposed to the crank chamber 16 by way of each of the escape sections 80*a* and 80*b*.

Therefore, the through holes 67*a*, 67*b*, 67*c* are opened during the period that a positive pressure is generated in the crank chamber 16 accompanying the downward movement of the pistons 35, 38. The lubricant oil is subjected to air pressure accompanying the gas within the crank chamber 16 pressurized by the pistons 35, 38 and the downward movement of the pistons 35, 38, and is blown away and pressed out to the clutch chamber 20 by way of the through holes 67*a*, 67*b*, 67*c* and the passage holes 63*a*, 63*b*, 63*c*.

Figure 16:
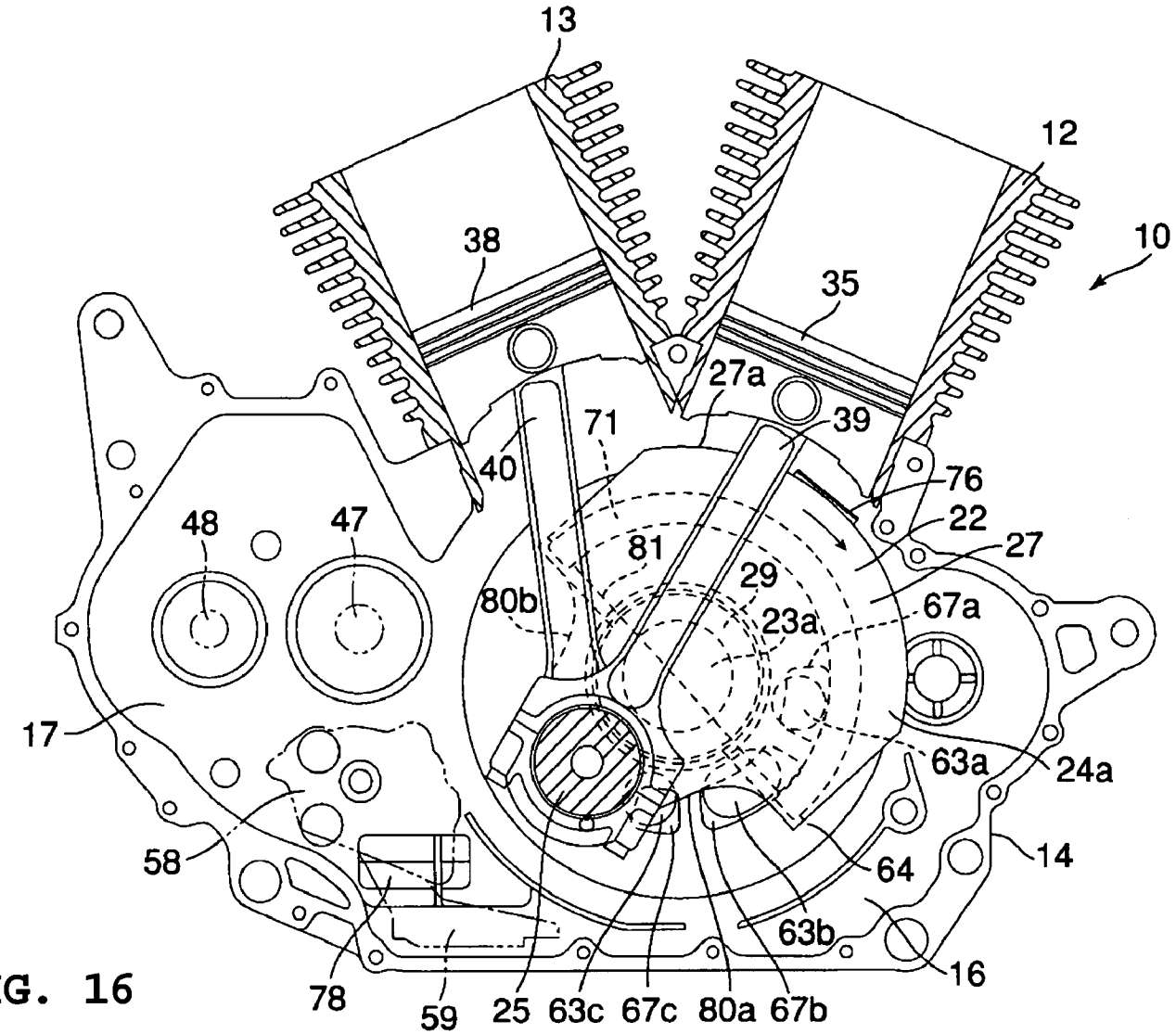
FIG. 16 is a cross sectional view showing the positional relationship between the through holes and the crank web when the piston of the rear cylinder rises upward in the air-cooled four-stroke V-type two-cylinder engine of the second embodiment of the present invention.

When the piston 38 of the rear cylinder 13 is at for example 72 degrees after the bottom dead center position as shown in FIG. 16, the side surface 70 of the balance weight 27 of the crank web 24*a* overlaps the through hole 67*a* and blocks the through hole 67*a*. All of the through holes 67*a*, 67*b*, 67*c* are also blocked in the stroke by the side surface 70 of the balance weight 27 until the piston 38 of the rear cylinder 13 reaches the top dead center position.

As a result at the point in time that a negative pressure acts on the crank chamber 16 along with the rise of the pistons 35, 38, the crank web 24*a* successively blocks the through holes 67*a*, 67*b*, 67*c*. A pressure differential is therefore maintained between the crank chamber 16 and the clutch chamber 20. The lubricant oil, pressed out of the crank chamber 16 into the clutch chamber 20 during the fall of the pistons 35, 38, is efficiently auctioned from the return hole 78.

In the present embodiment, the divider wall isolating the crank chamber and clutch chamber is made up of separate partition plates from the crankcase. However the present invention is not restricted to this structure. For example, if a sidewall of the crankcase facing the crank web is flat, then the sidewall may be utilized as the divider wall. In other words, the divider wall may be integrated as one piece with the crankcase or may be a separate piece.

Also the separate chamber adjoining the crank chamber is not limited to the clutch chamber. For example there is no problem whatsoever if the chamber is another compartment such as an electric generator compartment for storing an electrical generator.

The dry-sump, four-stroke engine of the present invention is not limited to a V-type two-cylinder engine and needless to say, may for example be a single cylinder engine.

The present invention as disclosed above renders the effect that the lubricant oil pressed out of the crank chamber into other chambers can be reliably recovered without having to utilize complex and expensive parts such as reed valves. The use of an increased number of parts can therefore be prevented with a simple structure. Further, no design changes for the crankcase are required and costs can be reduced.

What is claimed is:

1. A lubrication device for a dry-sump, four-stroke engine, comprising:

a crankcase having a divider wall;

a crank chamber and a separate chamber with the divider wall interposed in between the crank chamber and separate chamber;

a crankshaft housed in the crank chamber, driven by a reciprocating movement of pistons, and having a crank web facing the divider wall, wherein the crank chamber and the separate chamber are separated by the divider wall in a direction along an axis of the crankshaft;

a through hole formed in the divider wall for connecting the crank chamber with the separate chamber, and opened by the crank web when the piston moves from a top dead center position toward a bottom dead center position, and closed by the crank web when the piston moves from the bottom dead center toward the top dead center position;

a return hole connecting the crank chamber and the separate chamber, for returning lubricant oil that flowed by way of the through hole into the separate chamber from the crank chamber, back to the crank chamber by utilizing pressure fluctuations within the crank chamber; and an oil pump that auctions up the lubricant oil from a bottom region of the crank chamber.

2. The lubrication device for a dry-sump, four-stroke engine according to claim 1, wherein the through hole is formed at a position overlapping the crank web as seen along an axis of the crankshaft, and the return hole is formed at a position separate from the crank web.

3. The lubrication device for a dry-sump, four-stroke engine according to claim 2, wherein the crank web has a thick plate section forming a tiny first gap with the divider wall, and a thin plate section forming a second gap larger than the first gap with the divider wall, the thin plate section of the crank web faces the through hole when the piston moves from the top dead center position toward the bottom dead center position, and the thick plate section of the crank web faces the through hole when the piston moves from the bottom dead center position toward the top dead center position.

4. The lubrication device for a dry-sump, four-stroke engine according to claim 2, wherein the crank web has a link section connected by a crank pin and a balance weight projecting toward an opposite side of the link section relative to a rotational center of the crankshaft, the link section has a notched escape section to decrease a width dimension to less than a balance weight as seen along the axis of the crankshaft, the balance weight faces the through hole, blocking the through hole when the piston moves from the bottom dead center position toward the top dead center position and the escape section faces the through hole, exposing the through hole to the crank chamber when the piston moves from the top dead center position toward the bottom dead center position.

5. The lubrication device for a dry-sump, four-stroke engine according to claim 1, wherein the divider wall is formed by a partition plate separate from the crankcase, and the partition plate is affixed to the crankcase so as to adjoin the crank web.

6. The lubrication device for a dry-sump, four-stroke engine according to claim 5, wherein the crankshaft has a journal section protruding from the crank web, the crankcase has a sidewall with a cylindrical bearing for supporting the journal section to rotate freely and, multiple concavities opening toward the crank chamber and formed at mutually spaced intervals for surrounding the bearing in the sidewall, the partition plate is fastened to the sidewall of the crankcase so as to cover the concavities and at least one of the concavities has a passage hole for connecting the through hole of the partition plate with the separate chamber.

7. The lubrication device for a dry-sump, four-stroke engine according to claim 5, wherein the crankcase has an oil return path to supply lubricant oil returning from a cylinder head, to the separate chamber, the oil return path has an opening that opens onto the crank chamber further upstream than the separate chamber and the partition plate has a sealing section to seal the oil return path opening from an inner side of the crank chamber.

8. The lubrication device for a dry-sump, four-stroke engine according to claim 1, wherein the separate chamber is a clutch chamber for storing a wet type clutch immersed in the lubricant oil.

9. The lubrication device for a dry-sump, four-stroke engine according to claim 1, wherein the pistons are coupled to each other by way of connecting rods.

10. The lubrication device for a dry-sump, four-stroke engine according to claim 1, wherein the return hole is formed in the divider wall and is positioned more to a rear side of the crankshaft as seen along an axis of the crankshaft.

11. The lubrication device for a dry-sump, four-stroke engine according to claim 1, wherein the crankshaft includes a pair of journals.

12. A lubrication device for a dry-sump, four-stroke engine, comprising:

a crankcase having a divider wall;

a crank chamber and a separate chamber with the divider wall interposed in between the crank chamber and the separate chamber;

a crankshaft housed in the crank chamber, driven by a reciprocating movement of pistons, and having a crank web facing the divider wall, wherein the crank chamber and the separate chamber are separated by the divider wall in a direction alone an axis of the crankshaft;

a through hole formed in the divider wall for connecting the crank chamber with the separate chamber, and opened by the crank web during a period that a positive pressure is generated in the crank chamber, and closed by the crank web in a period that a negative pressure is generated in the crank chamber;

a return hole connecting the crank chamber and the separate chamber, for returning lubricant oil that flowed by way of the through hole into the separate chamber from the crank chamber, back to the crank chamber by utilizing pressure fluctuations within the crank chamber; and an oil pump that suctions up the lubricant oil from a bottom region of the crank chamber.

13. The lubrication device for a dry-sump, four-stroke engine according to claim 12, wherein the pistons are coupled to each other by way of connecting rods.

14. The lubrication device for a dry-sump, four-stroke engine according to claim 12, wherein the return hole is formed in the divider wall and is positioned more to a rear side of the crankshaft as seen along an axis of the crankshaft.

15. The lubrication device for a dry-sump, four-stroke engine according to claim 12, wherein the crankshaft includes a pair of journals.

16. A lubrication device for a dry-sump, four-stroke engine comprising:

a crankcase having a sidewall;

a crank chamber and a separate chamber with the sidewall interposed in between the crank chamber and separate chamber;

a crankshaft housed in the crank chamber, driven by a reciprocating movement of pistons, and having a crank web facing the sidewall and a journal section protruding from the crank web, wherein the crank chamber and the separate chamber are separated by the divider wall in a direction along an axis of the crankshaft;

a bearing formed in the sidewall for supporting the journal section of the crankshaft for a free rotational movement;

multiple concavities open toward the crank chamber and mutually formed at spaced intervals for surrounding the bearing in the sidewall;

a passage hole opening toward the separate chamber, and formed in at least one of the concavities;

a partition plate adjoining the crank web, and affixed to the sidewall to cover the concavities and the passage hole;

a through hole formed in the partition plate, and opened by the crank web when the piston moves from a top dead center position toward a bottom dead center position and closed by the crank web when the piston moves from the bottom dead center position toward the top dead center position;

a return hole connecting the crank chamber and the separate chamber, for returning lubricant oil that flowed by way of the through hole and the passage hole into the separate chamber from the crank chamber, back to the crank chamber by utilizing pressure fluctuations within the crank chamber; and an oil pump that suctions up the lubricant oil from a bottom region of the crank chamber.

17. The lubrication device for a dry-sump, four-stroke engine according to claim 16, wherein the passage hole and the through hole are mutually adjoining as seen axially along the crankshaft.

18. The lubrication device for a dry-sump, four-stroke engine according to claim 16, wherein the pistons are coupled to each other by way of connecting rods.

19. The lubrication device for a dry-sump, four-stroke engine according to claim 16, wherein the return hole is formed in the sidewall and is positioned more to a rear side of the crankshaft as seen along an axis of the crankshaft.

20. The lubrication device for a dry-sump, four-stroke engine according to claim 16, wherein the crankshaft includes a pair of journals.

* * * * *